US006540829B2

(12) United States Patent
Allman et al.

(10) Patent No.: US 6,540,829 B2
(45) Date of Patent: Apr. 1, 2003

(54) METAL ROOFING SHINGLE STOCK AND METHOD FOR MAKING IT

(75) Inventors: Jack C. Allman, Twin Lakes, WI (US); Ronald J. Lewarachik, Brighton, MI (US); Victor J. Scaricamazza, Mount Holly, NJ (US)

(73) Assignee: BASF Corporation, Southfield, MI (US)

( * ) Notice: Subject to any disclaimer, the term of this patent is extended or adjusted under 35 U.S.C. 154(b) by 0 days.

(21) Appl. No.: 10/087,636

(22) Filed: Mar. 1, 2002

(65) Prior Publication Data

US 2002/0092466 A1 Jul. 18, 2002

Related U.S. Application Data

(62) Division of application No. 09/320,049, filed on May 26, 1999.

(51) Int. Cl.[7] ..... B05C 19/04

(52) U.S. Cl. ..... 118/67; 118/68; 118/221; 118/223; 118/255; 118/262; 118/302; 118/304; 118/308; 118/312

(58) Field of Search ..... 118/67, 68, 77, 118/221, 223, 255, 261, 262, 304, 308, 312, 47, 302, 641; 427/194, 186, 446–448, 195

(56) References Cited

U.S. PATENT DOCUMENTS

| | | | | |
|---|---|---|---|---|
| 1,776,590 A | * | 9/1930 | Kirschbraun | 427/186 |
| 2,298,664 A | | 10/1942 | Van Patter | 117/27 |
| 2,536,042 A | | 1/1951 | Dorfan | 117/32 |
| 3,239,367 A | | 3/1966 | Demeter | 117/68 |
| 3,265,548 A | | 8/1966 | Harkins, Jr. et al. | 156/79 |
| 3,647,500 A | | 3/1972 | Mizuno | 117/21 |
| 3,687,800 A | | 8/1972 | Scheppers | 161/162 |
| 3,720,031 A | | 3/1973 | Wilson et al. | 52/520 |
| 3,773,544 A | | 11/1973 | Newton et al. | 117/49 |
| 3,861,971 A | * | 1/1975 | Stapleford et al. | 156/276 |
| 3,924,561 A | | 12/1975 | Ruthart et al. | 118/9 |
| 4,055,453 A | * | 10/1977 | Tajima et al. | 156/279 |
| 4,055,688 A | | 10/1977 | Caratsch | 427/195 |
| 4,064,288 A | | 12/1977 | Shah et al. | 427/58 |
| 4,091,135 A | | 5/1978 | Tajima et al. | 428/40 |
| 4,136,215 A | | 1/1979 | den Otter et al. | 427/204 |
| 4,141,313 A | | 2/1979 | Hefele | 118/212 |
| 4,180,609 A | | 12/1979 | Vassiliou | 428/212 |
| 4,265,938 A | | 5/1981 | Jack et al. | 427/163 |
| 4,295,445 A | | 10/1981 | Kopenhaver | 118/695 |
| 4,299,874 A | | 11/1981 | Jones et al. | 428/143 |
| 4,343,260 A | | 8/1982 | Yajima et al. | 118/204 |

(List continued on next page.)

FOREIGN PATENT DOCUMENTS

| | | |
|---|---|---|
| DE | 2008293 | 2/1970 |
| DE | 32 44 714 A1 | 6/1984 |
| EP | 0 369 477 A2 | 11/1989 |
| EP | 460973 A2 | 7/1991 |
| EP | 0 857 769 A1 | 2/1998 |
| JP | 55128453 | 10/1980 |
| JP | 3239542 | 10/1991 |

OTHER PUBLICATIONS

Merriam Webster's Collegiate Dictionary–10th ed, 1997, p376.
An English Abstract of DE 32 44 714 A1.
An English Abstract of EP 0 369 477 A2.

*Primary Examiner*—Laura Edwards

(57) ABSTRACT

A coil coating system for embedding discrete masses of material in a resinous coating on sheet metal as it is pulled from a dispensing coil through a series of rollers, said system comprising a paint pan, a roller rotating in the pan and picking up said resinous coating composition and transferring it to an applicator roller; thenceforth to the moving sheet metal, an oven, and a sprayer that can heat thermoplastic resin particles to a molten or plastic state and spray the particles to the moving sheet metal.

7 Claims, 4 Drawing Sheets

U.S. PATENT DOCUMENTS

| | | | | | |
|---|---|---|---|---|---|
| 4,348,447 | A | | 9/1982 | Miller, Jr. et al. | 428/149 |
| 4,352,837 | A | | 10/1982 | Kopenhaver | 427/187 |
| 4,356,216 | A | | 10/1982 | Gailey et al. | 427/286 |
| 4,356,217 | A | | 10/1982 | Wollam et al. | 427/286 |
| 4,400,487 | A | | 8/1983 | Stoneberg et al. | 525/199 |
| 4,416,940 | A | | 11/1983 | Loye et al. | 428/324 |
| 4,478,869 | A | | 10/1984 | Brady et al. | 427/10 |
| 4,497,274 | A | | 2/1985 | Focke | 118/221 |
| 4,529,625 | A | | 7/1985 | Reidenbach et al. | 427/186 |
| 4,610,929 | A | | 9/1986 | Mosser et al. | 428/421 |
| 4,741,132 | A | | 5/1988 | Emblin | 52/58 |
| 4,786,705 | A | | 11/1988 | Koleske | 528/72 |
| 4,969,251 | A | | 11/1990 | Burkhart, III et al. | 29/527.4 |
| 5,019,181 | A | | 5/1991 | Yazawa et al. | 148/12 EA |
| 5,048,453 | A | | 9/1991 | Eriksson | 118/249 |
| 5,101,759 | A | | 4/1992 | Hefele | 118/202 |
| 5,134,825 | A | | 8/1992 | Berridge | 52/520 |
| 5,251,989 | A | | 10/1993 | Di Luco | 400/240.3 |
| 5,288,356 | A | | 2/1994 | Benefiel | 16/196 |
| 5,362,316 | A | | 11/1994 | Paradise | 106/278 |
| 5,380,549 | A | | 1/1995 | Harvison | 427/137 |
| 5,380,552 | A | | 1/1995 | George et al. | 427/186 |
| 5,382,291 | A | | 1/1995 | Olioso | 118/212 |
| 5,415,717 | A | | 5/1995 | Perneborn | 156/276 |
| 5,478,414 | A | | 12/1995 | Mozelewski et al. | 148/265 |
| 5,516,549 | A | | 5/1996 | Jasenof et al. | 427/178 |
| 5,516,573 | A | | 5/1996 | George et al. | 428/143 |
| 5,538,762 | A | | 7/1996 | Ogawa et al. | 427/503 |
| 5,554,393 | A | * | 9/1996 | Uchida et al. | 425/101 |
| 5,565,260 | A | | 10/1996 | Hawk | 428/195 |
| 5,582,864 | A | | 12/1996 | Kiser | 427/186 |
| 5,597,618 | A | | 1/1997 | Bayer, Jr. et al. | 427/207.1 |
| 5,657,603 | A | | 8/1997 | Goodhart et al. | 52/519 |
| 5,688,598 | A | | 11/1997 | Keck et al. | 428/458 |
| 5,787,655 | A | | 8/1998 | Saylor, Jr. | 52/181 |
| 5,795,389 | A | * | 8/1998 | Koschitzky | 118/308 |
| 5,807,608 | A | | 9/1998 | O'Dell et al. | 427/195 |
| 5,814,369 | A | | 9/1998 | Bockh et al. | 427/188 |
| 5,827,608 | A | | 10/1998 | Rinehart et al. | 428/332 |
| 5,834,067 | A | | 11/1998 | Rodely | 427/469 |
| 6,040,414 | A | | 3/2000 | Temtchenko et al. | 528/70 |
| 6,083,627 | A | | 7/2000 | Keeny et al. | 428/435 |
| 6,113,978 | A | | 9/2000 | Ornstein et al. | 427/136 |

* cited by examiner

METAL ROOFING SHINGLE STOCK AND METHOD FOR MAKING IT

CROSS-REFERENCE TO RELATED APPLICATION

The present application is a divisional application of U.S. Ser. No. 09/320,049, filed on May 26, 1999, which is incorporated herein by reference.

FIELD OF THE INVENTION

This invention relates to a method for embedding a multiplicity of discrete masses of material in a resinous coating on a sheet of metal in a coil coating system. More particularly, it relates to a one-pass system wherein the sheet is coated, the masses are embedded in the wet resinous coating, and the coating is dried. It further relates to a coil of metal decorated with said embedded masses. It relates particularly to the decoration of sheet metal so that it is useful as stock in the manufacture of metal roofing shingles simulating the appearance of traditional asphalt shingles. To that end, this invention relates to coil coated sheet metal to which the coating adheres sufficiently well to permit post-coating forming, molding, bending, and shaping of the metal without delamination or flaking of the coating. It further relates to coil coated sheet metal on which the resinous coating is resistant to ultra-violet radiation and the embedded masses are ultra-violet resistant color bodies of various hues. The surface of the coating may be substantially free of protrusions but at least a portion of the discrete masses may protrude above the surface of the coating to impart slip resistance to shingles made from the coated stock.

BACKGROUND OF THE INVENTION

Mineral covered asphalt sheets, by far the most commonly used shingles, are sold with guarantees of from 15 to 30 years depending on the weight per 100 square feet. The mineral granules are gradually dislodged by wind and rain to expose the asphalt binder to the destructive effects of ultra-violet light. Because of an increasing desire to replace the asphalt with a substrate that has a much longer useful life—on the order of about 60 to 80 years—the development of metal roofing shingles has become more and more important. STONECREST Steel Shingles having multilayered coatings are made from a combination of steel, aluminum, and zinc by Metal Works of Pittsburgh. The cost of simulating the appearance of mineral covered asphalt shingles by forming shingles from coated sheet metal stock may in part be reduced to a commercially acceptable level by reducing the number of coating steps and the corresponding time.

In a conventional coil coating system, paint is picked up by a roller rotating in a paint pan and transferred to an applicator roller and a coil of sheet metal is uncoiled as the metal is pulled through a series of rollers, one or more of which is a paint applicator roller, at up to 1000 feet per minute. The coated metal is then passed through an oven for drying or curing and coiled again. The sheet is passed through the system each time a separate coating layer is to be applied.

To the knowledge of the instant inventors, none of the many patents directed to coil coating teach the coating of a face of sheet metal with a resinous composition and embedment of a second coating material in the wet surface of that coating in a single pass of the metal through a coil coating system. Several patents teach the coating of moving flexible substrates with two materials. The principal substrates are sheets of asphalt, PVC and fabric but metal is often mentioned as a potential substrate. U.S. Pat. No. 5,827,608, for example, teaches the electrostatic fluidized bed application of a coating powder (e.g., a blend of two distinct, chemically incompatible resins) onto the underside of a vinyl sheet being drawn from a coil at about 4 feet per minute, heating the powder and pressing it to fuse and bond it to the vinyl, and rewinding the coated sheet into a coil.

SUMMARY OF THE INVENTION

It is an object of this invention, therefore, to provide a coil of sheet metal having a resinous coating on one face and a multiplicity of discrete masses of material embedded in said coating.

It is another object of this invention to provide metal roofing shingle stock having a resinous coating on one face and a multiplicity of discrete masses of material embedded in said coating.

It is a related object of this invention to provide metal roofing shingle stock having a multiplicity of discrete color bodies embedded in a resinous coating.

It is another object of this invention to provide a method for coating one face of sheet metal with a resinous composition and embedding a particulate coating material in the wet surface of that coating during one pass of the metal through a coil coating system.

These and other objects of this invention which will become apparent from the appended drawings and the following description are achieved in one embodiment of the invention by a method for coating sheet metal which comprises unwinding the sheet metal from a coil thereof and directing the sheet metal through a series of rollers, one or more of which is an applicator roller, placing a liquid resinous coating composition in a paint pan, picking up said resinous coating composition on a rotating roller in the pan and and transferring it to an applicator roller; thenceforth transferring it as a protective coating to the moving sheet metal, distributing discrete masses of material uniformly on the liquid or at least plastic protective coating and causing at least a portion of them to submerge at least partially in said protective coating, drying said protective coating, and rewinding the coated metal sheet into a take-up coil. The method of this invention is characterized by distributing the discrete masses to form a discontinuous field coextensive with the area of the coating, thus simulating the appearance of conventional asphalt-based shingles.

DETAILED DESCRIPTION OF THE INVENTION

Figure 1:
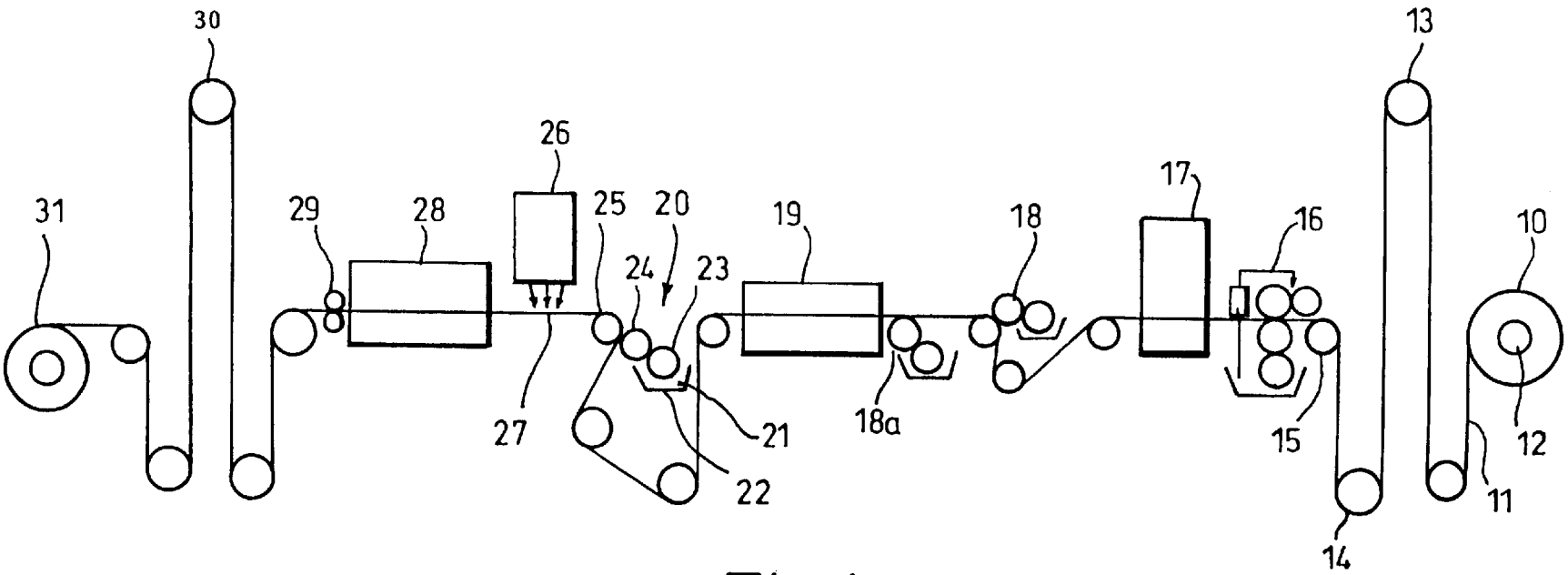
FIG. 1 is a schematic drawing of a coil coating line suitable for the distribution of color bodies on wet resinous coated sheet metal moving on the line.

As used herein, substantially means largely if not wholly that which is specified but so close that the difference is insignificant.

In the coil coating operation of this invention, substantially the full expanse of an aluminum or galvanized steel sheet is coated as it travels at 250–1000 feet per minute. Hot dipped galvanized (HDG) steel is suitable for low cost operations but a zinc/aluminum alloy such as that sold under the trademark GALVALUME is preferred for its corrosion resistance. Aluminum is more preferred when cost is not a limiting factor. Pretreatment of the metal is important for increased corrosion protection and adhesion of the coatings. Typical conversion coating compositions used in the pretreatment include those sold under the trademarks BONDERITE 1303 or 1310 for the GALVALUME metal, and BETZ 1500 and Morton's FIRST COAT for aluminum.

For optimum adhesion and corrosion resistance, it is preferable that the metal is coated with a primer over the conversion coating. Suitable primers for this invention include epoxy, acrylic, polyester, or polyurethane resins as binders. U.S. Pat. No. 5,001,173 is incorporated herein by reference for its description of primers that are suitable here. The primer thickness may be from 0.2 mil to 1.6 mils, preferably about 0.8 mil or more. Flexible primers are preferred when the coated metal stock is to be post formed in the manufacture of a roofing shingle. Greater flexibility may be achieved by the use of thick film primers such as are described in U.S. Pat. No. 5,688,598, which is incorporated herein by reference, and are available from Morton International, Inc. The peak metal temperature (PMT) for the curing of the primer is that recommended by the supplier but it is usually in the range of 435–465° F. (about 225–240° C.). Pigments such as those described below in regard to the topcoat and embedded particles are used to impart ultraviolet light resistance to the primers also.

For the purposes of this invention, the liquid resinous coating composition preferably comprises an ultraviolet light resistant pigment and a thermoplastic or thermosettable fluorocarbon resin. As used herein, a fluorocarbon resin is a homopolymer of vinyl fluoride or vinylidene fluoride or a copolymer of either of those two monomers with one another and/or other copolymerizable, fluorine-containing monomers such as chlorotrifluoroethylene, tetrafluoroethylene and hexafluoroethylene. Fluorocarbon resins are available under the trademarks KYNAR and HYLAR. Fluorocarbon resins and coating compositions comprising a fluorocarbon and an acrylate or methacrylate monomer or mixture of the two are described in U.S. Pat. No. 5,185,403, which is incorporated herein by reference. Coating compositions particularly suitable for the purposes of this invention are available under the trademark FLUOROCERAM. A mixture of a vinylidene fluoride/chlorotrifluoroethylene copolymer (55:45 by weight percent) and methylmethacrylate (MMA) wherein the weight ratio of the MMA to the copolymer is from about 2:1 to about 5:1 is also suitable.

A fluoropolymer particularly suited to the top coating over the conversion coating on unprimed sheet metal is described by Yamabe et al in U.S. Pat. No. 4,345,057. Commercially available fluoropolymer resins which are believed to be substantially similar to those described in the Yamabe et al patent include those sold under the trademarks ICI 302, ICI 504, and ICI 916. For the purposes of this invention, the word "drying" is used to mean the solidification of molten material and the curing of thermosettable resins as well as the evaporation of solvents. The thickness of the liquid resinous coating is such that it forms a 0.5 to 1.0 mil thick dry coating, preferably one that is about 0.8 mil or greater, to provide sufficient holding power for the discrete masses of submerged particulate material. It is preferable that the liquid resinous coating is still wet so as to promote the submergence and bonding of the discrete masses but a baked coating which is not fully cured may serve when softened as a plastic medium for the submergence of such particulate material. Thus, for the purposes of this invention, the term "liquid resinous coating" is defined to include a coating which is sufficiently plastic to be susceptible to penetration by a particulate material under the conditions of this invention without otherwise fracturing the coating. When the particulate material is a resin, it is suitable for the purposes of this invention to fuse the resin and cause it to merge with the protective coating. In some cases, such as when the particulate material is a thermosettable coating powder or an uncured thermosettable resin in some other form such as a chip, concurrent curing of the liquid protective coating and the particulate material may take place. The curing temperature for the fluoropolymers is usually at a PMT in the range of 465–480° F. (about 240–280° C.). The discrete masses of particulate material must, therefore, be able to withstand such high temperatures.

As used herein, the term "discrete masses" means individual particles of material as well as masses of particles such as are used in powder gravure coating processes and includes discrete color bodies as well as colorless particles. Pigmented particulate minerals and resins in the form of granules, beads, vesiculated beads, pellets, flakes, platelets, cylinders, coating powders, and chips such as coating powder precursor chips are suitable as discrete color bodies for the purposes of this invention. The minerals include glass, quartz, mica, pebbles, and ceramics. The particulate resins include polyesters, acrylics, nylons, polyurethanes, polycarbonates, solid fluorocarbon resins, and solid mixtures of a fluorocarbon and a polymer or copolymer of the acrylate or methacrylate monomers as described above in regard to the liquid resinous coating. Amorphous acrylic/styrene/acrylonitrile resins sold by General Electric under its GELOY trademark, noted for durability in weather related environments, are suitable for the purposes of this invention. The preferred granules are aggregates sold under the trademark COLORQUARTZ by 3M. The preferred spherical S grade granule has a particle size range of 20 to 70 (U.S. Sieve), which is about 8 to 30 mils. The resin particles are likewise about 8 mils or larger. Chips intended to be ground for conversion into coating powders, referred to hereinabove as coating powder precursor chips, are themselves quite suitable as the discrete color bodies for this invention.

Simulation of the asphalt shingle appearance may be achieved by contiguous discrete masses of different colors, by spacing of the masses by at least as much as the individual particle sizes, or both.

The pigments impart ultraviolet light resistance to the primer, the topcoat and the embedded color bodies and yield aesthetic effects. Most of the UV resistant pigments are metal oxides; examples of such include those sold as DUPONT Ti Pure R-960, COOKSON KROLOR KY-795 Med. Yellow (2), COOKSON KROLOR KY-281D Lt. Yellow (2), COOKSON KROLOR RKO 786D Orange (2), COOKSON KROLOR RKO 789D Orange (2), SHEPHERD # 1, SHEPHERD Yellow #29, ISHIHARA Titanium Golden, FERRO V9118 Bright Golden Yellow, Golden Brown #19, SHEPHERD #195 Yellow, HARCROSS Red Oxide R-2199, HARCROSS KROMA Red Oxide RO-8097, HARCROSS KROMA Red Oxide RO-4097, G-MN chrome oxide, and FERRO V-302. COLUMBIA RAVEN 1040 carbon black and the COOKSON A-150D laked black exemplify the non-metal oxide pigments which impart UV resistance to the top coat and embedded particles. A phthalocycanine green pigment sold as MONASTRAL Green GT-751D (5) is a UV resistant organometal pigment suitable for the purposes of this invention.

The amount of pigment used in each situation will vary according to the depth of coloration and UV resistance desired and according to the properties of the various pigments chosen.

The discrete masses of material embedded in the protective top coating may be made cellular in structure by the incorporation of blowing agents in their formulations in amounts such as are just sufficient to cause expansion of the particles while preferably avoiding perforation of the particles at temperatures up to and including 280° C.(~480° F.). An amount ranging from about 0.1 to about 3% by weight of the resin is satisfactory, the actual amount depending upon the particular foaming agent, the particular resin, the coating temperature, and the expansion desired. Blowing agents such as p-toluene sulfonyl hydrazide, 2,2'-azobis (isobutyronitrile), and azocarbonamide are suitable.

EMBODIMENTS OF THE INVENTION

In FIG. 1, the coil 10 of sheet metal 11 is operatively disposed on the unwinding device 12, from which the sheet travels through a pre-cleaning unit (not shown) and the first accumulator 13 of a conventional coil coating line. After leaving the first accumulator, the metal sheet 11 travels around rolls 14 and 15 to contact the applicator roll 16 of the pretreatment coater and through the drier 17 before it passes through the prime coater 18, the backing coater 18*a*, and drier 19. The sheet 11 is then passed through the applicator 20 where the liquid resinous coating composition 21 in the pan 22 is picked up by the roll 23, transferred to the applicator roll 24, and deposited on the metal as the wet top coat 25. The wet coated metal is then passed under the distributor 26 from which discrete masses 27 of organic or inorganic material are distributed uniformly on the wet resin. The coated sheet metal then travels through the oven 28, a set of pressure rollers 29 when necessary for the embedment of the masses 27, a quench unit (not shown), and the second accumulator 30 before it is taken up again on the rewind coil 31.

Figure 1A:
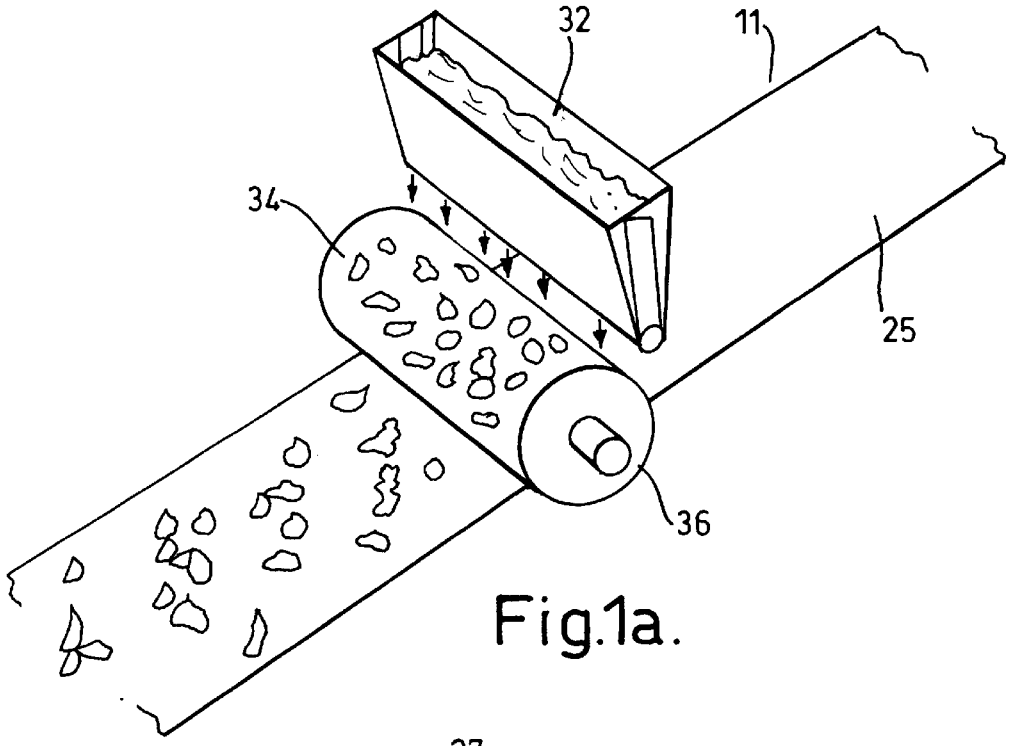
FIG. 1*a* is perspective view of one embodiment of the particle distributor of FIG. 1.

A particular embodiment of the distributor 26 of FIG. 1 is illustrated in FIG. 1*a* by the combination of the hopper 32 which feeds particulate matter into the multiplicity of pockets 34 engraved in the surface of the cylindrical roll 36 which rotates at a velocity matching the linear velocity of the metal sheet passing through the coil coating line. The engraved area of the roll corresponds to the width of the top-coated metal sheet 25 and the pockets are spaced apart to achieve the desired density of particulate matter on the wet topcoat. A static mixer available from 3M is particularly suitable as the hopper 32 for feeding granules to the roll 36.

Figure 1B:
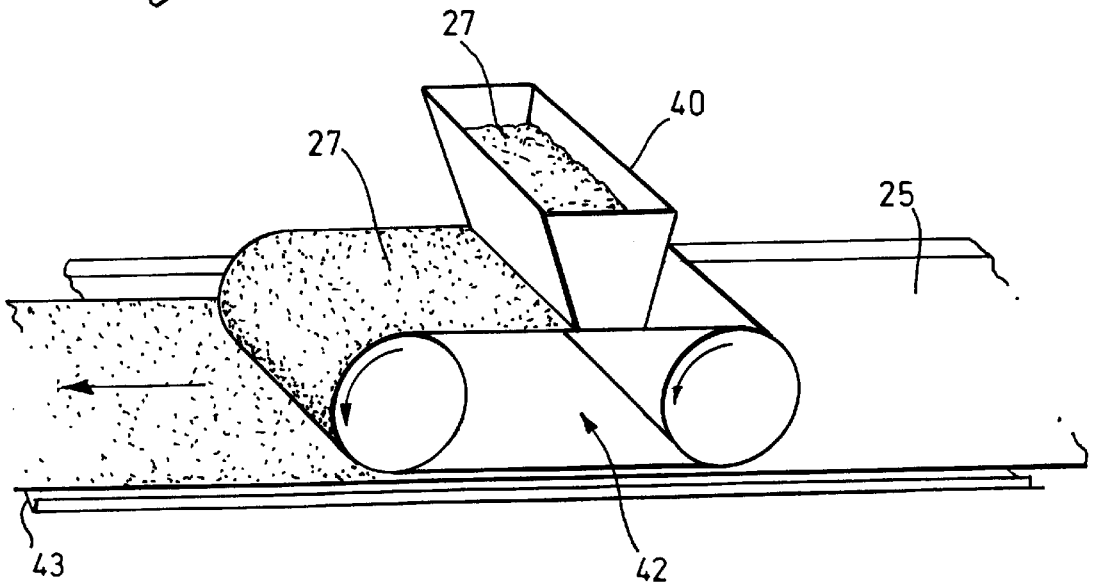
FIG. 1*b* is a perspective view of another embodiment of the particle distributor of FIG. 1.

Another embodiment of the invention is shown in FIG. 1*b*, wherein the discrete masses 27 are gravity fed from the hopper 40 onto the motorized continuous conveyor belt 42, which is disposed a short distance above the top-coated metal sheet 25. The belt 42 travels in the same direction and at the same linear velocity as the metal sheet as the masses 27 drop onto the sheet 25. The sheet and the conveyor belt 42 are disposed for a short distance within the trough 43 which collects any discrete masses 27 which fall from the conveyor but miss or fall off of the sheet. Such discrete masses thus collected in the trough may be returned to the hopper 40 by conventional means such as a blower situated within tubing connecting a chute in the trough and the hopper.

Figure 2:
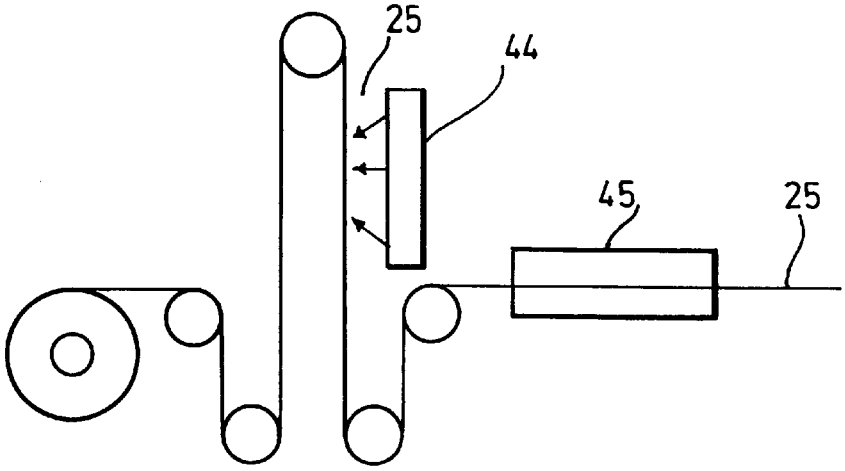
FIG. 2 is a schematic drawing of a flame spray system for projecting fused particles onto wet resinous coated sheet metal moving on a coil coating line.

In another embodiment of this invention, the distributor 26 of the coil coating line of FIG. 1 is replaced by the flame sprayer 44 shown in FIG. 2. Here, the topcoat on the metal sheet 25 is a thermoplastic resin which retains sufficient heat as it the leaves the oven 45 to remain soft. Particles of a thermoplastic resin are fed into the sprayer 44 disposed adjacent the ascending sheet 25. The sprayer instantly heats the particles to a molten or plastic state and propels the particles onto the surface of the still soft thermoplastic coating on the sheet 25 at a speed of about 30 to 60 feet per second, forming flattened plastic particles called splats which range from 0.5 mil to 4 mils in diameter. The size of the particles being fed into the sprayer 44, the distance from the sprayer to the surface of the top-coated sheet 25, and the rate of feed are controlled so that the flattened particles remain as uniformly distributed discrete masses in the top coat over substantially the full expanse of the coated metal sheet 25.

Figure 3:
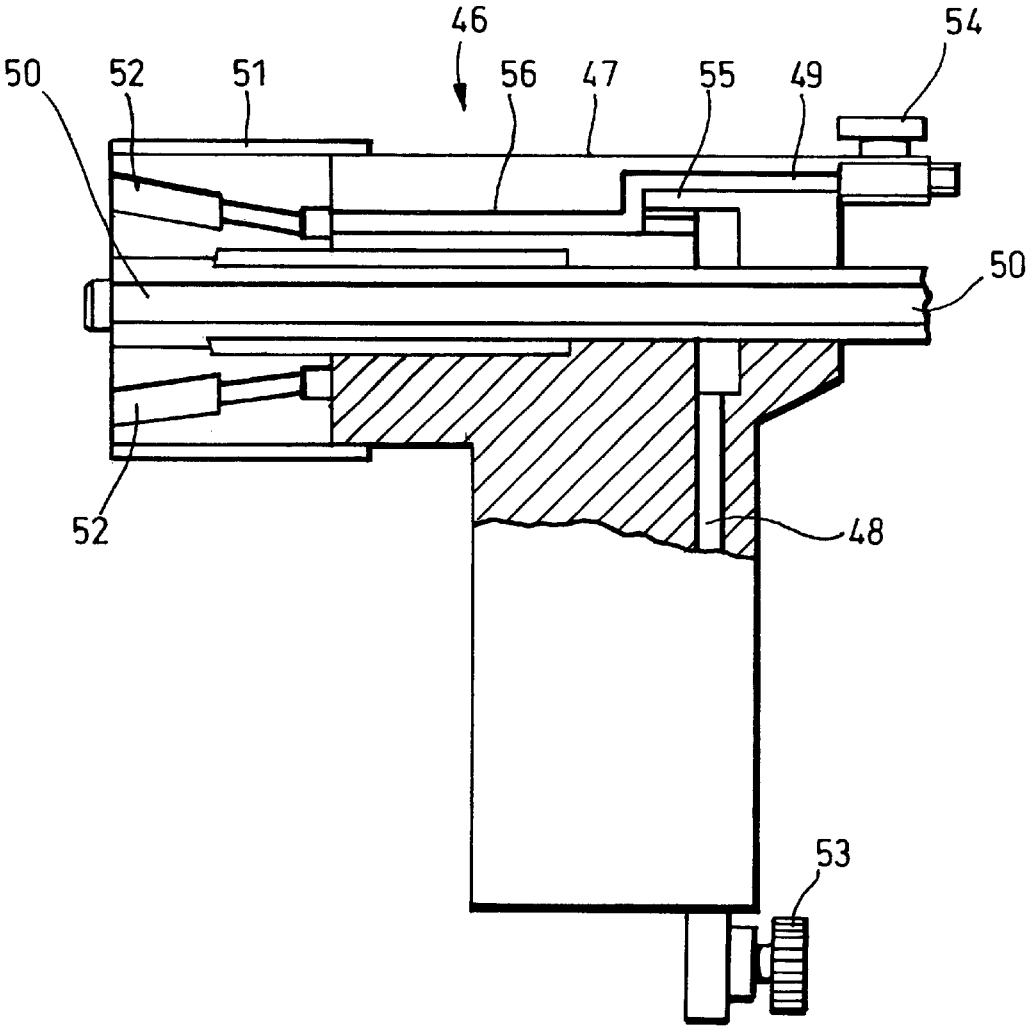
FIG. 3 is a plan view, partially broken away, of a flame spray gun for the system of FIG. 2.

A plurality of flame spray guns 46, each spraying particles of a different color, may be mounted in the flame sprayer 44 so as to form a multiplicity of splats over all or some lesser desired portion of the sheet metal surface. Flame spray gun 46 as illustrated in FIG. 3 has a body 47 with supply channels 48, 49, and 50 for air, fuel gas, and a fluidized coating powder, respectively. Channel 50 communicates with a fluidizing chamber (not shown) from which a coating powder suspended in a stream of compressed air is pushed intermittently into the flame spray gun 46 by rapidly opening and closing a valve in a supply line carrying a stream of compressed air and coating powder into the fluidizing chamber. The outlet of the powder channel is axially disposed within the gun mouthpiece 51 and combustion gas outlet nozzles 52 are situated in the mouthpiece 51 at equal distances around an imaginary circle concentric with the powder channel 50. The amounts of air and gas are regulated by valves 53 and 54. The air passes through the ejectors 55 creating a partial vacuum in the fuel gas channel 49 and drawing the gas into the mixing chambers 56. The combustible mixture flows through the mouthpiece nozzles 52 and burns. The powder particles are heated to a molten state as they pass quickly through the flame.

Figure 4:
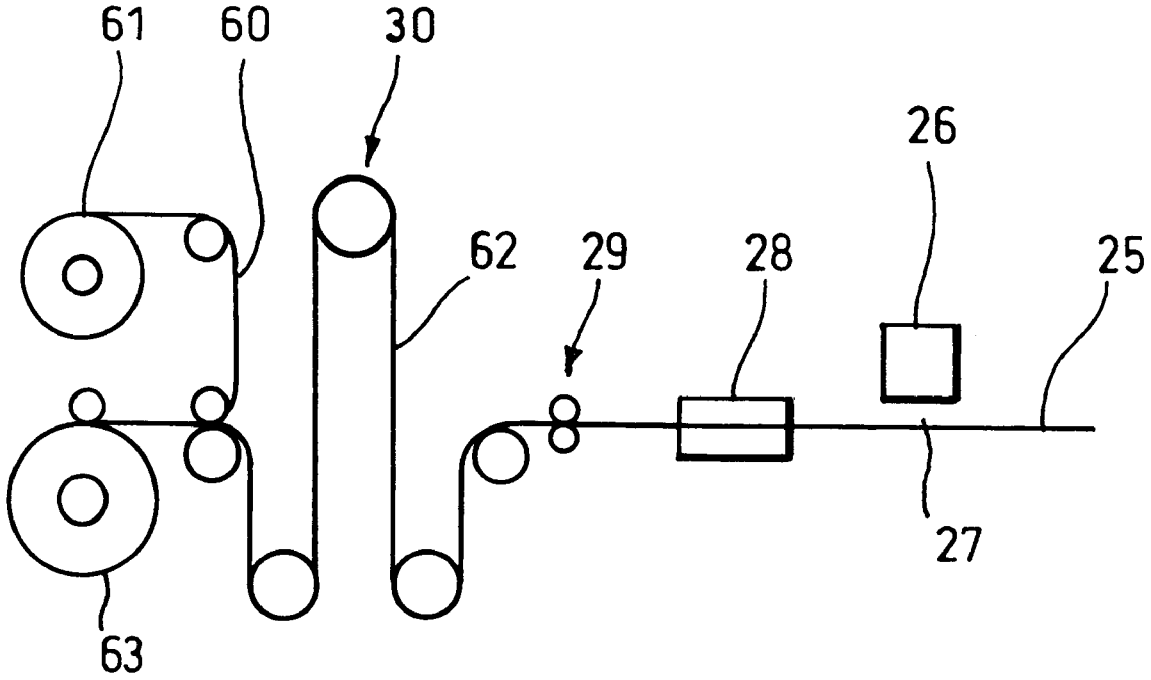
FIG. 4 is a schematic drawing of a coil coating line suitable for the distribution of ceramic granules on wet resinous coated sheet metal and the interleaving of a backing sheet with the coated sheet metal as it is rewound on a take up coil.

As illustrated in FIG. 4, when discrete masses 27 of FIG. 1 such as ceramic granules or the like protrude above the resinous top coat, a removable backer sheet 60 is drawn from the coil 61 and interleaved with the granule covered metal sheet 62 as it is rewound into the coil 63 in order to protect the underside of the sheet metal. The backer sheet 60 may be made of a foamed material such as polystyrene or poly (vinyl chloride).

What is claimed is:

1. A coil coating system for embedding discrete masses of material in a resinous coating on sheet metal as it is pulled from a dispensing coil through a series of rollers, said system comprising a paint pan, a roller rotating in the pan and picking up said resinous coating composition and transferring it to an applicator roller; thenceforth to the moving sheet metal, an oven, and a sprayer that can heat thermoplastic resin particles to a molten or plastic state and spray the particles to the moving sheet metal.

2. The system of claim 1 further comprising a winding device following the sprayer for rewinding the coated metal into a coil.

3. The system of claim 2 further comprising a source of backer sheet material for interleaving with the coated sheet metal as the coated sheet metal is rewound on the coil.

4. The system of claim 1 further comprising a distributor for depositing the discrete masses of material uniformly on the liquid coating as the sheet metal is moving, causing at least a portion of them to submerge at least partially in the liquid coating before the oven.

5. The system of claim 4, wherein the distributor comprises a hopper disposed over a cylindrical roll having a multiplicity of pockets that is disposed over the moving coated sheet metal.

6. The system of claim 4, wherein the distributor comprises a hopper disposed over a continuous conveyor belt that is disposed over the moving coated sheet metal.

7. The system of claim 4 further comprising rollers for substantially submerging all of the masses in the liquid coating.

* * * * *